US010316715B2

(12) United States Patent
Tsumagari et al.

(10) Patent No.: US 10,316,715 B2
(45) Date of Patent: Jun. 11, 2019

(54) BURNER

(71) Applicant: HINO MOTORS, LTD., Hino-shi, Tokyo (JP)

(72) Inventors: Ichiro Tsumagari, Hino (JP); Ryo Shibuya, Hino (JP); Shun Nakagawa, Hino (JP)

(73) Assignee: HINO MOTORS, LTD., Tokyo (JP)

( * ) Notice: Subject to any disclaimer, the term of this patent is extended or adjusted under 35 U.S.C. 154(b) by 99 days.

(21) Appl. No.: 15/160,673

(22) Filed: May 20, 2016

(65) Prior Publication Data

US 2016/0348898 A1 Dec. 1, 2016

(30) Foreign Application Priority Data

May 27, 2015 (JP) ..... 2015-107231

(51) Int. Cl.

| | |
|---|---|
| ***F23D 11/44*** | (2006.01) |
| ***F23D 11/40*** | (2006.01) |
| ***F01N 3/025*** | (2006.01) |
| ***F23D 11/38*** | (2006.01) |
| ***F23N 1/02*** | (2006.01) |
| ***F23D 99/00*** | (2010.01) |

(52) U.S. Cl.

CPC ..... *F01N 3/025* (2013.01); *F23D 11/40* (2013.01); *F23D 11/443* (2013.01); *F23D 91/02* (2015.07); *F23N 1/02* (2013.01); *F23N 2025/16* (2013.01)

(58) Field of Classification Search

CPC ..... F23D 11/406; F23D 11/002; F23D 91/02; F23D 11/443; F01N 3/0253; F01N 3/2033

USPC ..... 431/195–201, 338, 340, 342, 352

See application file for complete search history.

(56) References Cited

U.S. PATENT DOCUMENTS

| | | | | |
|---|---|---|---|---|
| 3,869,244 | A * | 3/1975 | Von Linde | F23C 7/06 431/116 |
| 3,947,230 | A * | 3/1976 | Zetterstrom | F23D 11/04 239/214.11 |
| 4,088,437 | A * | 5/1978 | Holzapfel | F23D 11/005 431/161 |
| 4,261,333 | A * | 4/1981 | Guarnaschelli | F24J 2/4647 126/612 |
| 4,291,681 | A * | 9/1981 | Berringer | F24J 2/201 126/673 |

(Continued)

FOREIGN PATENT DOCUMENTS

| | | | | |
|---|---|---|---|---|
| EP | 0413214 | A2 * | 2/1991 | F23D 11/443 |
| JP | 2011-185493 | A | 9/2011 | |

*Primary Examiner* — Avinash A Savani
*Assistant Examiner* — Rabeeul I Zuberi
(74) *Attorney, Agent, or Firm* — Kilpatrick Townsend & Stockton LLP

(57) ABSTRACT

The burner includes a first tube portion having a tube end including an ejection port and a second tube portion extending toward the ejection port in the first tube portion. The combustion gas generated by combusting air-fuel mixture is ejected from the ejection port. The second tube portion includes a heat exchanging portion that vaporizes liquid fuel with combustion heat of the combustion chamber and supplies the vaporized fuel to the premixing chamber. The outer surface of the second tube portion functions as a heat receiving surface of the heat exchanging portion. A fuel supply section of the burner is configured to vaporize liquid fuel and supply the vaporized fuel to the premixing chamber, and supply liquid fuel to the heat exchanging portion.

5 Claims, 5 Drawing Sheets

(56) References Cited

U.S. PATENT DOCUMENTS

| | | | | |
|---|---|---|---|---|
| 6,109,339 | A * | 8/2000 | Talbert | F24D 11/0214<br>126/101 |
| 2007/0113476 | A1 * | 5/2007 | Thomas | B01B 1/005<br>48/198.7 |

* cited by examiner

BURNER

BACKGROUND OF THE INVENTION

The present invention relates to a burner for raising the temperature of exhaust gas and, in particular, to a premixing type burner in which a mixture of fuel and air is supplied to a combustion chamber.

Conventional diesel engines include, in the exhaust passage, a diesel particulate filter (DPF), which captures particulate matter (PM) contained in exhaust gas. In such a DPF, in order to maintain the function of capturing particulate matter, a regeneration process, in which particulate matter captured by the DPF is burnt using exhaust gas, is performed.

For example, Japanese Laid-Open Patent Publication 2011-185493 discloses an exhaust purification device in which combusted gas is generated by combusting a mixture of fuel and air in a combustion chamber of a burner arranged upstream of the DPF. Supply of combustion gas to exhaust gas in the exhaust passage raises the temperature of the exhaust gas that flows into the DPF.

As such a burner, a premixing type burner is known that supplies a mixture of fuel and air to the combustion chamber without separately supplying fuel and air to the combustion chamber to improve the ignitability or the combustibility of the air-fuel mixture, thereby reducing unburned fuel contained in the combustion gas.

Combustion gas generated by the aforementioned premixing type burner contains more than a little unburned fuel. Since the unburned fuel is not used to generate the power of the engine, it is preferable to reduce the fuel used for increasing the temperature of the exhaust gas to reduce the amount of fuel consumption in the vehicle including the engine. Thus, it is desired to reduce unburned fuel on combustion so that fuel required for obtaining a predetermined heat amount is reduced.

SUMMARY OF THE INVENTION

An objective of the present invention is to provide a burner that reduces unburned fuel in combustion gas.

A burner according to one embodiment of the present disclosure includes: a first tube portion having a tube end including an ejection port, wherein combustion gas generated by combusting air-fuel mixture is ejected from the ejection port; a second tube portion having an open end and a closed end, the closed end being located closer to the ejection port than the open end, the second tube portion extending in the first tube portion toward the ejection port; a burner head that connects an inner circumferential surface of the first tube portion with an outer circumferential surface of the second tube portion, wherein the burner head and the second tube portion partition a space inside the first tube portion into a premixing chamber including a space inside the second tube portion and a combustion chamber located outside the second tube portion, the combustion chamber leading to the ejection port; a communication passage provided in the burner head, the communication passage allowing air-fuel mixture in the premixing chamber to pass to the combustion chamber; a heat exchanging portion arranged in the second tube portion, wherein the heat exchanging portion vaporizes liquid fuel with combustion heat of the combustion chamber and supplies the vaporized fuel to the premixing chamber, and an outer surface of the second tube portion functions as a heat receiving surface of the heat exchanging portion; an ignition portion arranged in the combustion chamber; and a fuel supply section configured to vaporize liquid fuel and supply the vaporized fuel to the premixing chamber, and supply liquid fuel to the heat exchanging portion.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE PREFERRED EMBODIMENTS

First Embodiment

A burner according to a first embodiment of the present disclosure will now be described with reference to FIG. 1.

Figure 1:
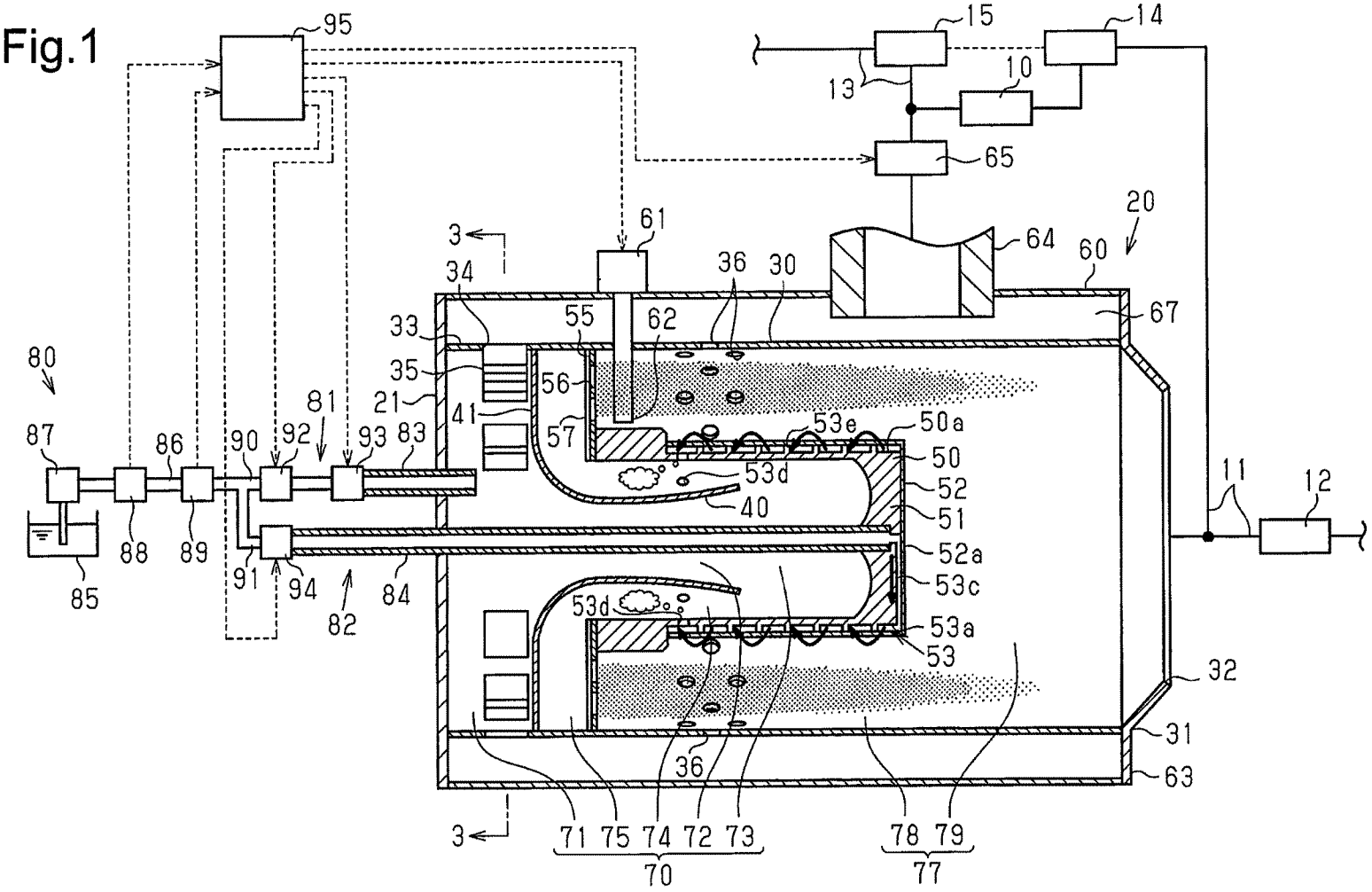
FIG. 1 is a diagram showing a schematic general arrangement of a burner according to a first embodiment of the present disclosure.

As shown in FIG. 1, a diesel engine 10 (hereinafter, referred to simply as the engine 10) includes a diesel particulate filter 12 (hereinafter, referred to as the DPF 12) mounted in an exhaust passage 11, and the diesel particulate filter 12 adsorbs particulate matter contained in exhaust gas.

The DPF 12, which is a component of an exhaust purification device, has a honeycomb structure made of, e.g., a porous silicon carbide and captures particulate matter in exhaust gas at the inner wall surfaces of columnar bodies that define the honeycomb structure. A burner 20 is mounted upstream of the DPF 12, and carries out a regeneration process of the DPF 12 by raising the temperature of the exhaust gas flowing into the DPF 12.

A cylindrical inner tube 30, which is one example of a first tube portion, is fixed to a basal plate 21 of the burner 20. The basal plate 21 closes the basal end of the inner tube 30. An annular ejection plate 31 is fixed to the distal end of the inner tube 30. The inner edge of the ejection plate 31 defines an ejection port 32.

A cylindrical tube portion 40 is located inside the inner tube 30. An annular joint wall portion 41, which is integrated with the tube portion 40, couples the inner surface of the inner tube 30 to the outer surface of the tube portion 40. The outer circumferential edge of the joint wall portion 41 is fixed to the inner tube 30 at a location closer to the basal plate 21 of the inner tube 30. Thus, the joint wall portion 41 closes the gap between the inner surface of the inner tube 30 and the outer surface of the tube portion 40. The joint wall portion 41 is shaped such that the joint wall portion 41 approaches the ejection port 32 as the distance from the tube portion 40 decreases. The tube portion 40 extends toward the ejection port 32 from a portion coupled to the joint wall portion 41, and the tube end that is located closer to the ejection port 32 is open. The inner diameter of the tube portion 40 gradually increases toward the ejection port 32 to allow fuel adhered to the inner surface of the tube portion 40 to be readily discharged toward the ejection port 32.

The inner tube 30 includes an extension 33, which extends from a portion of the inner tube 30 that is coupled to the joint wall portion 41 toward the basal plate 21. The extension 33 includes first air introducing ports 34, which are spaced at predetermined intervals in the circumferential direction. The first air introducing ports 34 introduce air for combustion into a mixing chamber 71, which is a space surrounded by the extension 33. The extension 33 includes raised portions 35. Each of the raised portions 35 is formed by cutting and raising a part of the circumferential wall of the extension 33 from the open edge of the corresponding first air introducing port 34. The air introduced into the mixing chamber 71 flows into a mixing chamber 72, which corresponds to a space in the tube portion 40 located closer to the ejection port 32 than the mixing chamber 71. The inner tube 30 includes a plurality of second air introducing ports 36 for introducing air for combustion inside the inner tube 30. The second air introducing ports 36 are located between an ignition portion 62 and the ejection port 32.

A heat receiving tube 50, which is a component of a second tube portion, is located inside the inner tube 30. The heat receiving tube 50 includes an open end, which is an opened tube end. The tube portion 40 is inserted into the heat receiving tube 50 through the open end. The heat receiving tube 50 includes a closing portion 51. One of two tube ends of the heat receiving tube 50 that is located closer to the ejection port 32 than the tube portion 40 is a closed end, which is closed by the closing portion 51. In other words, the closing portion 51 is a component of the closed end of the second tube portion. The inside of the heat receiving tube 50 corresponds to mixing chambers 72, 73, and 74. The mixing chambers 72, 73, and 74 are continuous with the mixing chamber 71, which is surrounded by the extension 33 and located between the joint wall portion 41 and the basal plate 21. The open end of the heat receiving tube 50 is fixed to an annular burner head 55, which connects the inner circumferential surface of the inner tube 30 with the outer circumferential surface of the heat receiving tube 50.

Figure 2:
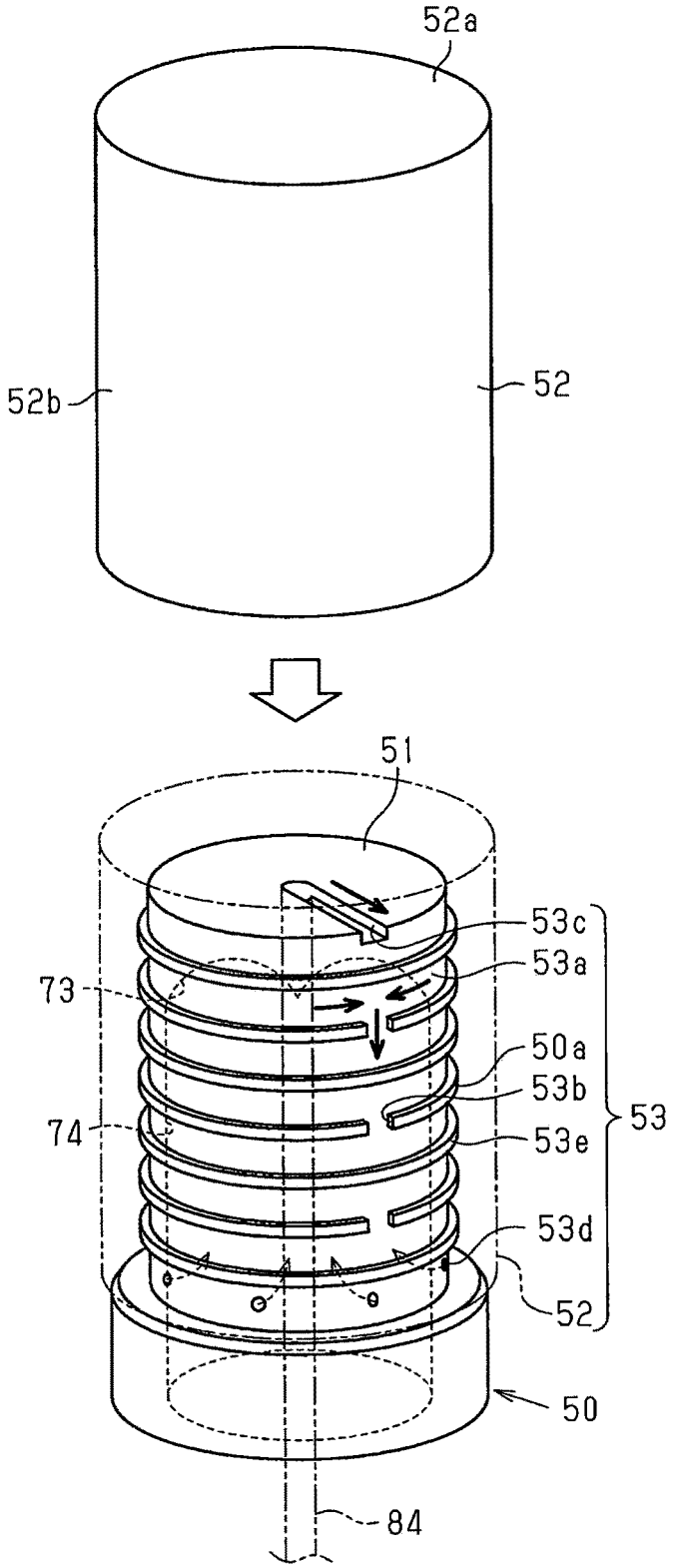
FIG. 2 is a perspective view of a heat receiving tube and a cover of the burner in FIG. 1.

As shown in FIG. 2, the outer circumferential surface of the heat receiving tube 50 is covered by a cover 52, which is a component of the second tube portion. The second tube portion includes the heat receiving tube 50 and the cover 52. The heat receiving tube 50 and the cover 52 are excellent in heat resistance to function as a burner, and are made of a metal material such as SUS310, which has excellent thermal conductivity. The outer circumferential surface of the heat receiving tube 50 and the cover 52 are components of a heat exchanging portion 53, which converts combustion heat of a first combustion chamber 78 into heat for vaporization of liquid fuel.

A plurality of grooves 53*a* is formed on an outer circumferential surface 50*a* of the heat receiving tube 50. The grooves 53*a* are parallel to each other and extend in the circumferential direction. The parallel grooves 53*a* join with joint grooves 53*b*. The grooves 53*a* and the joint grooves 53*b* function as a groove portion continuous from the closed end to the open end of the second tube portion.

The closing portion 51 of the heat receiving tube 50 includes an inlet groove 53*c*, which extends from the center of the heat receiving tube 50 in the radial direction and is connected to the grooves 53*a*. One end of the inlet groove 53*c* is connected to a liquid fuel supply pipe 84, which extends in the axial direction of the heat receiving tube 50 in the mixing chamber 72, which is an inner gap of the heat receiving tube 50. The other end of the inlet groove 53*c* is connected to the groove 53*a* that is located at the most distal end of the grooves 53*a*.

In addition, among the grooves 53*a*, the groove 53*a* that is located the closest to the open end of the heat receiving tube 50 includes outlet ports 53*d* arranged on the outer circumferential surface of the heat receiving tube 50. The outlet ports 53*d* extend through the outer circumferential wall of the heat receiving tube 50 in the thickness direction. In other words, the open end of the heat receiving tube 50 is one example of an outflow end of the second tube portion. With the outlet ports 53*d*, the inside of the heat exchanging portion 53 is in communication with the mixing chamber 74, which is an inner gap of the heat receiving tube 50. The outlet ports 53*d* are arranged, e.g., at equal intervals in the circumferential direction of the outer circumferential surface 50*a* so that vaporized fuel flows out evenly in the circumferential direction of the mixing chamber 74. The intervals and the number of the outlet ports 53*d* are not limited to the above arrangement.

The tubular cover 52 with a closed end is fitted onto the heat receiving tube 50 configured as above. The cylindrical circumferential wall of the cover 52 covers the outer circumferential surface 50*a* of the heat receiving tube 50. The bottom wall 52*a*, which is a distal end wall of the cover 52, is a component of the closed end of the second tube portion, and covers the closing portion 51 of the heat receiving tube 50. When the cover 52 is fitted on the heat receiving tube 50, the inner surface of the cylindrical circumferential wall 52*b* of the cover 52 is in contact with the outside ends of groove walls 53*e* that are located between the respective adjacent grooves 53*a*. The cover 52 defines a flow passage of liquid fuel between the heat receiving tube 50 and the cover 52. The bottom wall 52*a* of the cover 52 closes the inlet groove 53*c* to define a flow passage toward the grooves 53*a*. In other words, the closed end (the closing portion 51) of the heat receiving tube 50 and the distal end wall (the bottom wall 52*a*) of the cover 52 are one example of an inflow end of the second tube portion. A closed flow passage is defined by the grooves 53*a* and the joint grooves 53*b* between the inlet groove 53*c* and the outlet ports 53*d*.

In the heat exchanging portion 53 configured as above, when a flame is generated in the first combustion chamber 78, the outer surface of the cover 52 functions as a heat receiving surface and the heat by the combustion in the first combustion chamber 78 heats the cover 52 and the heat receiving tube 50. Liquid fuel is supplied to the grooves 53*a* from the liquid fuel supply pipe 84 through the inlet groove 53*c*. The liquid fuel flows, as shown with arrows of FIG. 2, from the inlet groove 53*c* to the outlet ports 53*d* along the grooves 53*a* and the joint grooves 53*b* in turn. In this process, the heat exchanging portion 53 converts combustion heat of the first combustion chamber 78 into heat for vaporizing liquid fuel so that the liquid fuel changes to vaporized fuel. Thus, the vaporized fuel flows out from the outlet ports 53*d* into the mixing chamber 74 inside the heat receiving tube 50. The liquid fuel flowing in the grooves 53*a* directly contacts a surface that defines grooves 53*a* and the inner surface of the cover 52. This improves heat exchange efficiency.

As shown in FIG. 1, the inner circumferential edge of the burner head 55 joins to the heat receiving tube 50 over the entire circumference of the outer circumferential surface 50*a* of the heat receiving tube 50. The outer circumferential edge of the burner head 55 joins to the inner tube 30 over the entire circumference of the inside surface of the inner tube 30. The burner head 55 and the heat receiving tube 50 partition the inside space of the inner tube 30 into two spaces. One of the two spaces is the combustion chamber 77, which is a space closer to the ejection port 32 than a boundary defined by the burner head 55 and the heat receiving tube 50. The other space is the premixing chamber 70, which is a space closer to the basal plate 21 than the boundary defined by the burner head 55 and the heat receiving tube 50. The burner head 55 includes a plurality of communication passages 56, with which the combustion chamber 77 is in communication with the premixing chamber 70. A wire mesh 57 is attached to the surface of the burner head 55 that is closer to the mixing chamber 75 and covers the communication passages 56.

An ignition portion 62 of a spark plug 61 is located between the burner head 55 and the ejection port 32. The spark plug 61 is fixed to a cylindrical outer tube 60, into which the heat receiving tube 50 is inserted. The ignition portion 62 is located in the inner tube 30 through through-holes formed in the outer tube 60 and the inner tube 30.

The burner 20 includes the mixing chamber 73 that is located closer to the ejection port 32 than the tube portion 40. The mixing chamber 73 is a space surrounded by the heat receiving tube 50 and the closing portion 51 and is in communication with the mixing chamber 72. The burner 20 further includes the mixing chamber 74 in a space between the tube portion 40 and the heat receiving tube 50. The mixing chamber 74 is in communication with the mixing chamber 73. The vaporized fuel, which is vaporized in the heat exchanging portion 53, flows out from the outlet ports 53*d* to the mixing chamber 74. The burner 20 further includes the mixing chamber 75 between the joint wall portion 41 and the burner head 55. The mixing chamber 75 is continuous with the mixing chamber 74. Air for combustion is supplied to the first combustion chamber 78 through the mixing chambers 71, 72, 73, 74, and 75 in this order. Hereinafter, the mixing chambers 71, 72, 73, 74, and 75 are collectively referred to simply as the premixing chamber 70.

The burner 20 includes the first combustion chamber 78, which is a gap between the inner tube 30 and the heat receiving tube 50, and a second combustion chamber 79 located between the closing portion 51 and the ejection port 32 in the space surrounded by the inner tube 30. The first combustion chamber 78 and the second combustion chamber 79 form the combustion chamber 77.

The fuel supply section 80, which supplies fuel to the premixing chamber 70, includes a vaporized fuel supply section 81 and a liquid fuel supply section 82. The vaporized fuel supply section 81 supplies vaporized fuel to the premixing chamber 70, and the liquid fuel supply section 82 supplies liquid fuel to the premixing chamber 70.

The vaporized fuel supply section 81 includes a vaporized fuel supply pipe 83, and the liquid fuel supply section 82 includes a liquid fuel supply pipe 84. The vaporized fuel supply pipe 83 and the liquid fuel supply pipe 84 are fixed to the basal plate 21 at the central portion. The vaporized fuel supply pipe 83 has a distal end located in the mixing chamber 71. The liquid fuel supply pipe 84 passes through the mixing chambers 72 and 73 in the heat receiving tube 50, extends to the central portion of the closing portion 51, and is connected to the inlet groove 53*c*.

The fuel supply section 80 has a common flow pipe 86 for supplying fuel in a fuel tank 85 to the vaporized fuel supply pipe 83 and the liquid fuel supply pipe 84. A mechanical fuel pump 87 driven by the engine 10, a fuel pressure sensor 88 for detecting the pressure of fuel, and a fuel temperature sensor 89 for detecting the temperature of fuel, are arranged along the common flow pipe 86. The common flow pipe 86, the fuel pump 87, the fuel pressure sensor 88, and the fuel temperature sensor 89 function for both of the vaporized fuel supply section 81 and the liquid fuel supply section 82.

The common flow pipe 86 is divided into a vaporized fuel branch pipe 90 and a liquid fuel branch pipe 91 downstream of the fuel temperature sensor 89. The vaporized fuel branch pipe 90 connects the common flow pipe 86 to the vaporized fuel supply pipe 83. The vaporized fuel branch pipe 90 includes a vaporized fuel on-off valve 92 and an electric heater 93. The vaporized fuel on-off valve 92 is a normally closed solenoid valve, which opens or closes the vaporized fuel branch pipe 90 by duty control. The electric heater 93 is located downstream of the vaporized fuel on-off valve 92. The electric heater 93 in the on-state is supplied with a predetermined amount of electric power by a power source (not shown) to generate heat, which vaporizes liquid fuel that passes through the electric heater 93. The vaporized fuel supply pipe 83 supplies vaporized fuel delivered from the electric heater 93 to the mixing chambers 71 and 72. The vaporized fuel branch pipe 90, the vaporized fuel on-off valve 92, and the electric heater 93 are components of the vaporized fuel supply section 81.

The liquid fuel branch pipe 91 connects the common flow pipe 86 to the liquid fuel supply pipe 84. The liquid fuel branch pipe 91 includes the liquid fuel on-off valve 94 for opening and closing the liquid fuel branch pipe 91. The liquid fuel on-off valve 94 is a normally closed solenoid valve, which opens or closes the liquid fuel branch pipe 91 by duty control. The liquid fuel supply pipe 84 supplies fuel that has passed through the liquid fuel on-off valve 94 to the liquid fuel supply pipe 84. The liquid fuel branch pipe 91 and the liquid fuel on-off valve 94 are components of the liquid fuel supply section 82.

The vaporized fuel supply pipe 83, which includes a distal end located in the mixing chamber 71, supplies fuel to the mixing chambers 71 and 72. The fuel is mixed with air for combustion from the mixing chamber 71 to generate air-fuel mixture. After flowing in the mixing chamber 72 toward the ejection port 32, the air-fuel mixture turns around in the mixing chamber 73 and flows in the mixing chamber 74 in the direction opposite to the flow in the mixing chamber 72. After that, the air-fuel mixture again turns around in the mixing chamber 75, and flows into the combustion chamber 77 through the communication passages 56 of the burner head 55.

Liquid fuel is supplied from the liquid fuel supply pipe 84 to the heat exchanging portion 53. The liquid fuel is also heated in a section upstream of the inlet groove 53*c* since the liquid fuel supply pipe 84 extends in the axial direction of the heat receiving tube 50. The liquid fuel travels from the inlet groove 53*c*, which is located at the distal end of the heat exchanging portion 53, along the grooves 53*a* and the joint grooves 53*b* and flows to the outlet ports 53*d*, which are located at the basal end of the heat exchanging portion 53. At this moment, when the heat exchanging portion 53 has been heated by a flame in the first combustion chamber 78, the liquid fuel is vaporized with vaporization heat between the inlet groove 53*c* and the outlet ports 53*d* to become vaporized fuel. The vaporized fuel generated in the heat exchanging portion 53 flows out from the outlet ports 53*d* to the mixing chamber 74. Thus, the vaporized fuel is mixed with air for combustion in the mixing chambers 74 and 75 to generate air-fuel mixture. After that, the air-fuel mixture again turns around in the mixing chamber 75 and flows into the combustion chamber 77 through the communication passages 56 of the burner head 55.

The ignition portion 62 ignites air-fuel mixture that has flowed into the combustion chamber 77 to generate combustion reaction gas in the combustion chamber 77. The combustion reaction gas contains a flame, which is air-fuel mixture during combustion, and combustion gas, which is air-fuel mixture after the combustion. The heat receiving tube 50 and the cover 52 are heated by the combustion reaction gas, which flows toward the ejection port 32, to heat air-fuel mixture in the mixing chambers 73 and 74 and heat the cover 52 and the heat receiving tube 50, which are components of the heat exchanging portion 53.

The outer tube 60, into which the inner tube 30 is inserted, is fixed to the basal plate 21. The outer tube 60 has two tube ends. The tube end at the basal end side is closed by the basal plate 21. The tube end at the distal end side of the outer tube 60 is closed by an annular closing plate 63 between the outer tube 60 and the heat receiving tube 50.

An air supply pipe 64 has the downstream end connected to the outer tube 60 in an area closer to the ejection port 32. The air supply pipe 64 has the upstream end connected to an intake passage 13 of the engine 10 at the downstream of the compressor 15, which is rotated with a turbine 14 arranged in exhaust passage 11.

The air supply pipe 64 includes an air valve 65. When the air valve 65 is open, some of the intake air flowing in the intake passage 13 flows into an air flow chamber 67 between the inner tube 30 and the outer tube 60, through the air supply pipe 64 as air for combustion. The air for combustion is supplied to the combustion chamber 77 through the second air introducing ports 36 and introduced to the mixing chamber 71 through the first air introducing ports 34.

A controller 95 controls the opening/closing of the aforementioned vaporized fuel on-off valve 92, the opening/closing of the liquid fuel on-off valve 94, the on/off of the electric heater 93, the opening/closing of the air valve 65, and the driving of the spark plug 61. The controller 95 controls the opening/closing of the vaporized fuel on-off valve 92 and the on/off of the electric heater 93 to control the driving of the vaporized fuel supply section 81. The controller 95 controls the opening/closing of the liquid fuel on-off valve 94 to control the driving of the liquid fuel supply section 82. For example, the controller 95 is embodied by one or more dedicated hardware circuits and/or one or more processors (control circuitry) operating according to computing programs (software). The processor includes a CPU and a memory such as RAM and ROM. The memory stores program codes and commands configured to execute processes, e.g., shown in FIG. 4, on the processor. The memory, i.e., a computer readable medium, may include any available media that an all-purpose or exclusive computer can access.

The controller 95 computes the accumulation amount of particulate matter in DPF 12 in a predetermined control cycle, e.g., based on the exhaust flow amount and the pressure loss of the exhaust gas in the DPF 12. The controller 95 starts a regeneration process of the DPF 12 by the burner 20 when the accumulation amount exceeds a threshold and the regeneration process is required. The controller 95 finishes the regeneration process when the accumulation amount decreases to a level below a threshold at which it is determined that sufficient particulate matter has been burnt.

In the regeneration process, the controller 95 determines a fuel supply amount Qf that is supplied to the premixing chamber 70 based on the temperature of the DPF 12 and the target temperature of the DPF 12, the exhaust temperature and the exhaust flow amount in the exhaust passage 11, and a state temperature T of the heat receiving tube 50. The controller 95 determines an air-to-be-burned amount Qa based on the fuel supply amount Qf. The air-to-be-burned amount Qa is an amount of air necessary for combusting fuel of the fuel supply amount Qf. The controller 95 controls the driving of the fuel supply section 80 based on the pressure and the temperature of fuel in the common flow pipe 86 such that fuel of the fuel supply amount Qf is supplied to the premixing chamber 70. In addition, the controller 95 controls the opening/closing of the air valve 65 such that air of the air-to-be-burned amount Qa is supplied to the air flow chamber 67.

The controller 95 has a first driving state, a second driving state, and a third driving state as driving states of the fuel supply section 80. In the first driving state, fuel supply to the premixing chamber 70 is performed only by the vaporized fuel supply section 81. In the second driving state, fuel supply to the premixing chamber 70 is performed by both the vaporized fuel supply section 81 and the liquid fuel supply section 82. In the third driving state, fuel supply to the premixing chamber 70 is performed only by the liquid fuel supply section 82.

The controller 95 obtains the state temperature T, which is the temperature of the heat receiving tube 50, as an index for controlling the driving of the fuel supply section 80. The state temperature T may be a temperature based on a detection signal from a temperature sensor that directly detects the temperature of the heat receiving tube 50 or a temperature estimated based on information of various kinds of sensors, a fuel injection amount, or other information.

When the state temperature T is less than or equal to a first threshold T1, the controller 95 drives the fuel supply section 80 in the first driving state. When the state temperature T is higher than the first threshold T1 and less than or equal to a second threshold T2, the controller 95 drives the fuel supply section 80 in the second driving state. When the state temperature T is higher than the second threshold T2, the controller 95 drives the fuel supply section 80 in the third driving state.

In the first driving state, the controller 95 starts the opening/closing control of the vaporized fuel on-off valve 92 after the electric heater 93 reaches a predetermined temperature. The controller 95 controls the opening/closing of the vaporized fuel on-off valve 92 such that fuel of the fuel amount Qf1, which can be continuously vaporized by the electric heater 93, flows into the electric heater 93. In other words, the fuel supply amount Qf in the first driving state is the fuel amount Qf1.

The first threshold T1 is a temperature at which heat by the heat receiving tube 50 and the cover 52 vaporizes liquid fuel even if liquid fuel of a fuel amount Qf2 is supplied to the heat exchanging portion 53 in addition to the vaporized fuel from the vaporized fuel supply section 81. In the second driving state, the controller 95 controls the opening/closing of the vaporized fuel on-off valve 92 of the vaporized fuel supply section 81 such that fuel of the fuel amount Qf1 flows into the electric heater 93. The controller 95 controls the opening/closing of the liquid fuel on-off valve 94 of the liquid fuel supply section 82 such that liquid fuel of the fuel amount Qf2 is supplied to the heat exchanging portion 53. In other words, the fuel supply amount Qf in the second driving state is a fuel amount Qf3 (Qf3=Qf1+Qf2).

The second threshold T2 (a target temperature) is a temperature at which liquid fuel is vaporized with vaporization heat from the heat exchanging portion 53 even if fuel of the fuel amount Qf2 is supplied to the heat exchanging portion 53 as liquid fuel. In the third driving state, the controller 95 controls the vaporized fuel on-off valve 92 in the closed state and stops power supply to the electric heater 93 of the vaporized fuel supply section 81. The controller 95 controls the opening/closing of the liquid fuel on-off valve 94 of the liquid fuel supply section 82 such that liquid fuel of the fuel supply amount Qf is supplied to the premixing chamber 70 while discretely increasing the fuel supply amount Qf, i.e., fuel amounts Qf3, Qf4, Qf5, Qf6, along with the increase of the state temperature T.

Figure 3:
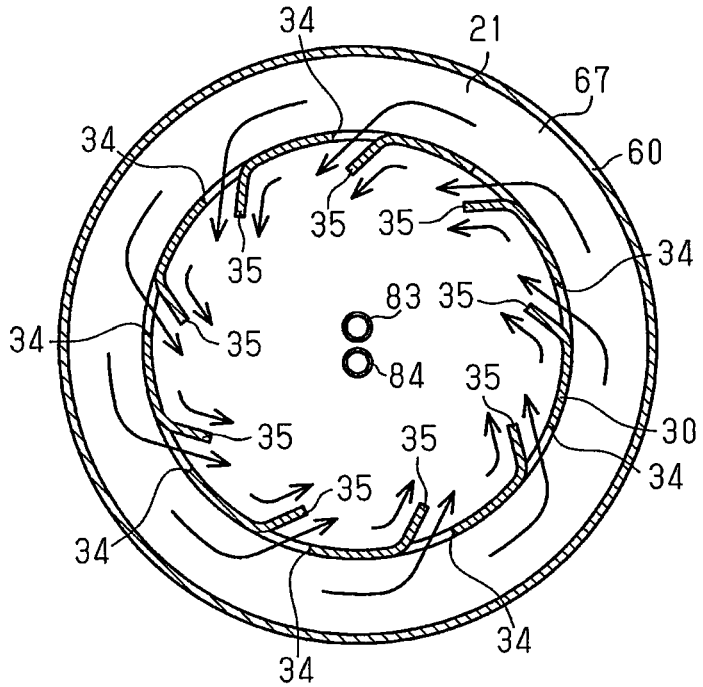
FIG. 3 is a cross-sectional view taken along line 3-3 of FIG. 1.

FIG. 3 is a cross-sectional view of the burner taken along line 3-3 of FIG. 1, showing a cross-sectional structure. The arrows of FIG. 2 show general flows of air for combustion. As shown in FIG. 2, the raised portions 35 formed in the extension 33 of the inner tube 30 are located to cover the respective first air introducing ports 34. Each of the raised portions 35 directs air for combustion that flows into the mixing chamber 71 through the first air introducing ports 34 to flow in the circumferential direction of the inner tube 30. This generates swirling flows of air for combustion in the mixing chamber 71. The swirls are maintained even after the air has flowed into the first combustion chamber 78. The combustion reaction gas flows toward the ejection port 32 while swirling around the heat receiving tube 50 in the first combustion chamber 78.

Figure 4:
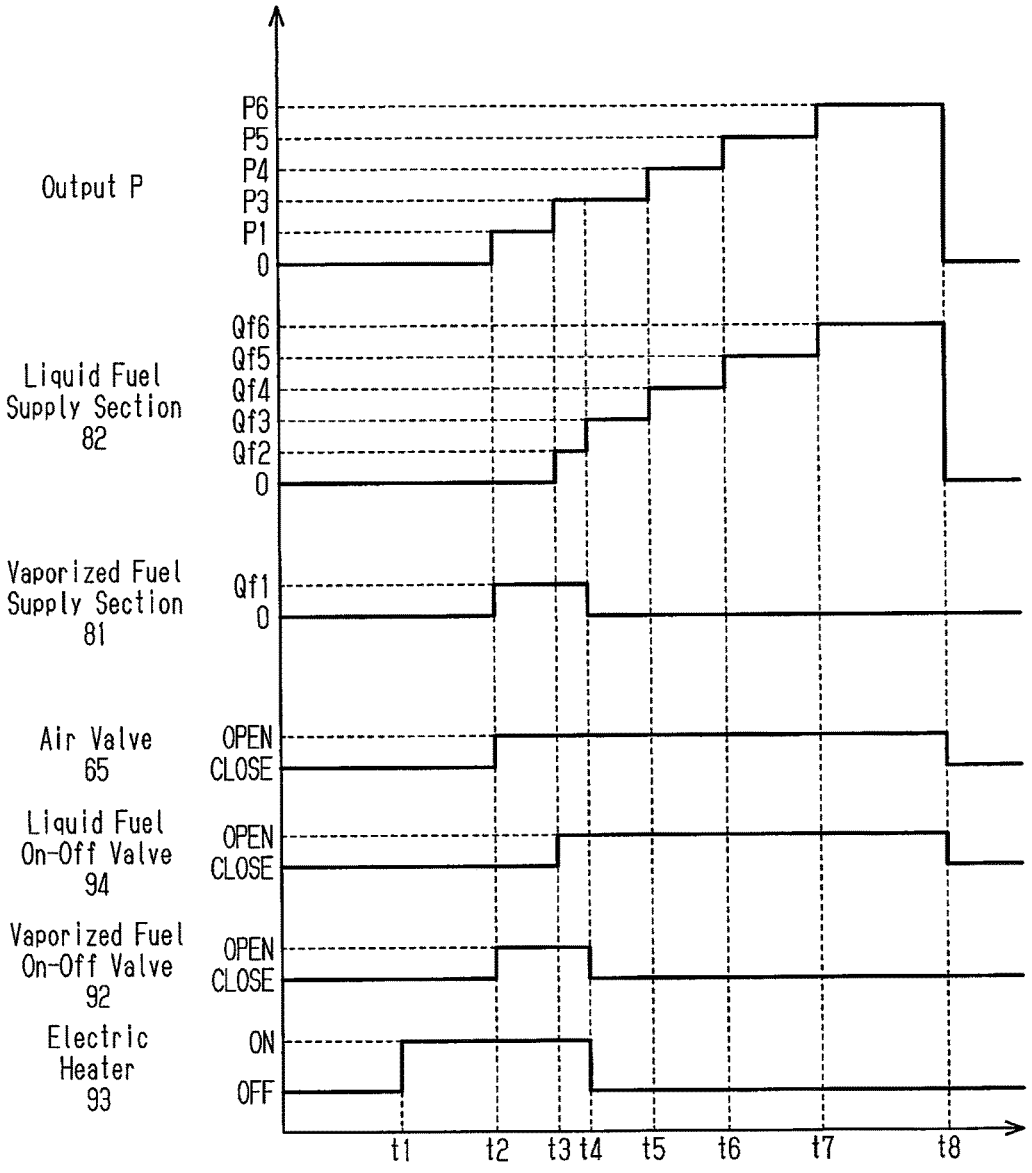
FIG. 4 is a timing diagram showing one example of a manner in which the burner in FIG. 1 operates.

With reference to FIG. 4, a manner in which the fuel supply section 80 operates will now be described. In an initial state of the burner 20, the vaporized fuel on-off valve 92, the liquid fuel on-off valve 94, and the air valve 65 are controlled to be in the closed states, and the electric heater 93 is controlled to be in the off-state.

As shown in FIG. 4, when a regeneration process is started at a time point t1, the controller 95 turns on the electric heater 93. The controller 95 starts the opening/closing control of the air valve 65 and the vaporized fuel on-off valve 92 when determining that the electric heater 93 has reached a predetermined temperature at a time point t2 when a predetermined amount of time has passed after the time point t1. This supplies fuel of the fuel amount Qf1 that has been vaporized by the electric heater 93 to the premixing chamber 70 from the vaporized fuel supply pipe 83. After passing through the mixing chambers 72 to 75, the air-fuel mixture containing the vaporized fuel flows into the first combustion chamber 78 through the communication passages 56 of the burner head 55 and is ignited by the spark plug 61. The controller 95 drives the fuel supply section 80 in the first driving state during the period from the time point t2 to the next time point t3. The burner 20 has an output P1 in accordance with the fuel amount Qf1.

When determining that the state temperature T reaches the first threshold T1 at the time point t3, the controller 95 starts the opening/closing control of the liquid fuel on-off valve 94. This supplies vaporized fuel of the fuel amount Qf1 from the vaporized fuel supply pipe 83 and supplies liquid fuel of the fuel amount Qf2 from the liquid fuel supply pipe 84 to the heat exchanging portion 53. In other words, the controller 95 drives the fuel supply section 80 in the second driving state during the period from the time point t3 to the next time point t4. The burner 20 has an output P3 in accordance with the fuel amount Qf3 (Qf3=Qf1+Qf2).

When determining that the state temperature T reaches the second threshold T2 (the target temperature) at the time point t4, the controller 95 controls the vaporized fuel on-off valve 92 in the closed state and controls the opening/closing of the liquid fuel on-off valve 94 such that liquid fuel of the fuel amount Qf3 is supplied from the liquid fuel supply pipe 84 to the heat exchanging portion 53. In other words, the controller 95 drives the fuel supply section 80 in the third driving state after the time point t4. The controller 95 discretely increases the fuel supply amount Qf along with increase of the state temperature T such that the fuel supply amount Qf becomes fuel amounts Qf4, Qf5, and Qf6 at time points t5, t6, and t7, respectively. The controller 95 controls the opening/closing of the liquid fuel on-off valve 94 such that liquid fuel of fuel amounts Qf4, Qf5, and Qf6 is supplied to the premixing chamber 70 at time points t5, t6, and t7, respectively. In accordance with the fuel supply amount Qf, the burner 20 has an output P3 from the time point t4 to the time point t5, an output P4 from the time point t5 to the time point t6, an output P5 from the time point t6 to the time point t7, and an output P6 from the time point t7 to a time point t8.

When the accumulation amount becomes lower than a threshold with which it is determined that particulate matter has been sufficiently burnt at the time point t8, the controller 95 controls the air valve 65 and the liquid fuel on-off valve 94 in the closed states to finish the regeneration process.

The first embodiment has the following advantages.

(1) In the burner 20, the heat exchanging portion 53 includes the outer circumferential surface 50*a* of the heat receiving tube 50 and the cover 52. Thus, the cover 52 and the heat receiving tube 50 are heated by a flame so that the heat exchanging portion 53 efficiently changes liquid fuel to vaporized fuel. In addition, adhesion of unburned fuel on the inner circumferential of the heat receiving tube 50 is limited. As a result, combustion quality of air-fuel mixture is improved to reduce unburned fuel.

(2) In a system of vaporizing fuel with heat from the electric heater 93, the electric heater 93 requires driving power whenever the burner 20 is driven. Thus, it is desired to reduce the amount of electric power required for driving of the electric heater 93. According to the above-illustrated configuration, combustion reaction gas efficiently heats the heat receiving tube 50 of the heat exchanging portion 53. This reduces the amount of time of driving the electric heater 93 and limits the amount of electric power required for driving of the electric heater 93.

(3) Liquid fuel flowing through the flow passage (grooves 53*a* and 53*b*) between the heat receiving tube 50 and the cover 52 is heated by a flame of the combustion chamber 77. This efficiently changes the liquid fuel to vaporized fuel.

(4) The outer circumferential surface 50*a* of the heat receiving tube 50 includes grooves (53*a* and 53*b*), which are continuous from the closed end to the open end. Thus, the whole of the liquid fuel between the closed end and the open end is heated so that the liquid fuel is efficiently changed to vaporized fuel.

The first embodiment may be modified in the following forms.

The shape or the pattern of the heat exchanging portion 53 may be modified as long as the flow passage to the outlet ports 53*d* has a length enough to heat liquid fuel for vaporization. For example, the number of the grooves 53*a* of the heat exchanging portion 53, which are parallel with each other, is not particularly limited as long as it is possible to vaporize liquid fuel.

It is not necessary to arrange the grooves 53*a* in parallel on the outer circumferential surface 50*a* of the heat receiving tube 50 of the heat exchanging portion 53. The groove

53*a* may be formed to be a spiral groove, in which one flow passage extends from the inlet groove 53*c* to the outlet ports 53*d*.

It is not necessary to arrange the grooves 53*a* over the outer circumferential surface 50*a* from the distal end to the basal end. For example, the outlet ports 53*d* may be arranged in the middle between the distal end and the basal end of the outer circumferential surface 50*a* as long as it is possible to vaporize liquid fuel. Furthermore, the outlet ports 53*d* may be located at the distal end of the outer circumferential surface 50*a* as long as it is possible to vaporize liquid fuel. In other words, the heat exchanging portion 53 may be configured such that liquid fuel is supplied from the distal end of the heat receiving tube 50 and vaporized fuel flows out from the distal end of the heat receiving tube 50.

The number of inlet grooves 53*c* at the closing portion 51 does not necessarily need to be one. A plurality of inlet grooves 53*c* may be provided. For example, the inlet grooves 53*c* may be arranged radially from the center of the closing portion 51, to which the liquid fuel supply pipe 84 connects.

Second Embodiment

Figure 5:
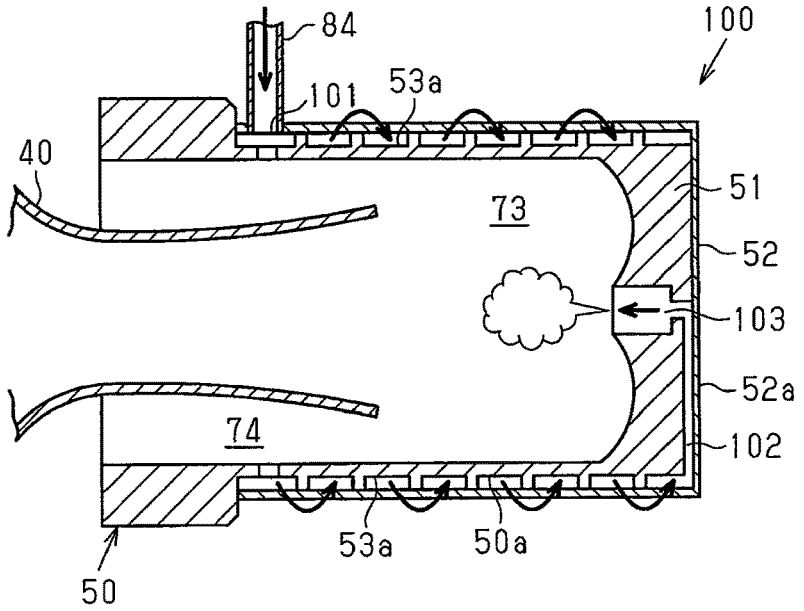
FIG. 5 is a cross-sectional view of a modification of the heat exchanging portion, showing an example in which vaporized fuel flows out from the closed portion of the heat exchanging portion.

FIG. 5 shows a modification of the heat exchanging portion 53. In the heat exchanging portion 100 shown in FIG. 5, liquid fuel is supplied from the basal end of the heat exchanging portion 100, and vaporized fuel flows out from the closing portion 51, which is the distal end of the heat receiving tube 50. In other words, the open end of the heat receiving tube 50 is one example of an inflow end of the second tube portion. The closed end of the heat receiving tube 50 and the distal end of the cover 52 are one example of an outflow end of the second tube portion.

In particular, the liquid fuel supply pipe 84 is connected to the basal end of the cover 52, which is fitted onto the heat receiving tube 50, and an inflow portion 101 of liquid fuel is provided at the basal end of the cover 52. The grooves 53*a* are provided on the outer circumferential surface 50*a* of the heat receiving tube 50, and the grooves 53*a* are parallel to each other in the circumferential direction. The parallel grooves 53*a* are connected by the joint grooves 53*b*. An ejection groove 102 is provided on a surface closer to the ejection port 32 of the closing portion 51. The ejection groove 102 radially extends from the center and is connected to the groove 53*a*. One end of the ejection groove 102 is connected to the groove 53*a* next to the ejection groove 102 on the outer circumferential surface. The other end is connected to an outlet port 103, which is formed in the central portion of the closing portion 51.

In the heat exchanging portion 100 configured as above, liquid fuel is supplied from the liquid fuel supply pipe 84 to the inflow portion 101. As shown with the arrows of FIG. 5, the liquid fuel flows along the grooves 53*a* and the joint grooves 53*b* in turn from the side close to the inflow portion 101 toward the ejection groove 102 and the outlet port 103. In this process, the heat exchanging portion 100 converts combustion heat of the first combustion chamber 78 into vaporization heat and changes the flowing liquid fuel to vaporized fuel. Thus, the vaporized fuel flows out from the outlet port 103 to the mixing chamber 73 inside the heat receiving tube 50.

The second embodiment has the following advantages.

(5) In the second embodiment, fuel vaporized by the heat exchanging portion 100 flows out to the mixing chamber 73. The mixing chamber 73 is located upstream of the mixing chamber 74 in the flow of air for combustion. Thus, the air for combustion is steadily mixed with vaporized fuel.

(6) Since the liquid fuel supply pipe 84 is not provided inside the heat receiving tube 50, no obstacles exist in swirling flows of air for combustion from the mixing chamber 71 toward the first combustion chamber 78. Thus, the swirling flows are not easily disturbed.

The second embodiment may be modified in the following form.

As long as it is possible to vaporize liquid fuel, the liquid fuel supply pipe 84 may be connected to the outer circumferential surface in the middle between the distal end and the basal end of the cover 52.

Third Embodiment

Figure 6:
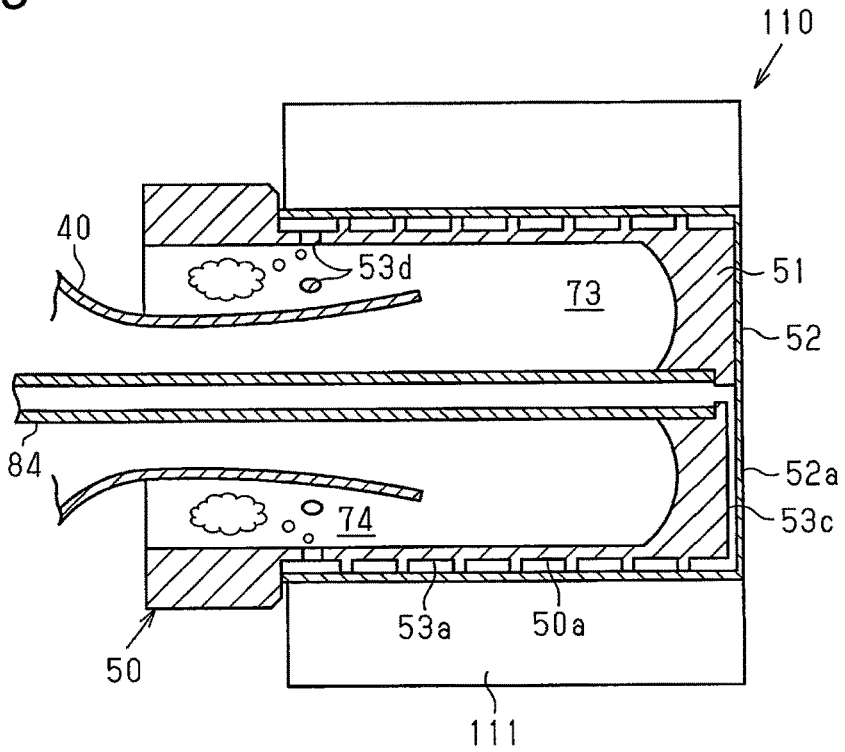
FIG. 6 is a cross sectional view of a modification of the heat exchanging portion, showing an example in which fins are arranged on a cover.

FIG. 6 shows a modification of the heat exchanging portion 53. A heat exchanging portion 110 shown in FIG. 6 includes a plurality of fins 111 on the outer circumferential surface of the cover 52. Each of the fins 111 has the longitudinal direction in the axial direction of the heat receiving tube 50. The fins 111 are substantially shaped the same and arranged at equal intervals over the outer circumferential surface.

The fins 111 increase an area receiving heat, which is the surface area of the heat receiving tube 50 in the combustion chamber 77. This increases the area where combustion reaction gas contacts the heat receiving tube 50. The combustion reaction gas efficiently heats the heat receiving tube 50, and the heat receiving tube 50 efficiently heats air-fuel mixture in the mixing chambers 73 and 74. The fins 111 may be provided on the outer circumferential surface of the cover 52 according to the first embodiment. The fins 111 may be provided on the outer circumferential surface of the cover 52 according to the second embodiment.

By providing the fins 111, the heat receiving tube 50 of the heat exchanging portion 53, and the cover 52 are efficiently heated with combustion reaction gas. Thus, compared to the first and second embodiments, the amount of time required for the second tube portion to reach the target temperature, i.e., the amount of time required for the state temperature T of the heat receiving tube 50 to reach the second threshold, is further reduced. This further accelerates the timing to stop the driving of the vaporized fuel supply section 81. Thus, the driving time of the electric heater 93 is further reduced.

The third embodiment may be modified in the following form.

The shape of each fin 111 is not limited to the shape in which its longitudinal direction is the axial direction of the heat receiving tube 50 and the fins 111 are parallel to each other. For example, the fin 111 may have a spiral shape. Furthermore, adjacent fins 111 may have different heights, or each fin 111 may have uneven heights.

The first to third embodiments may be modified in the following form.

In the heat exchanging portions 53, 100, and 110, a flow passage through which liquid fuel is supplied to the outlet ports 53*d* is configured such that the grooves 53*a* and the inner surface of the cover 52 close the circumferential surface of the flow passage. However, a flow passage through which liquid fuel is supplied may be configured with a pipe. In this case, the pipe is arranged, e.g., in a spiral around the outer circumference of the heat receiving tube 50. In this case, the cover 52 may be omitted.

Therefore, the present examples and embodiments are to be considered as illustrative and not restrictive and the invention is not to be limited to the details given herein, but may be modified within the scope and equivalence of the appended claims.

The invention claimed is:

1. A burner comprising:

a first tube portion having a tube end including an ejection port, wherein combustion gas generated by combusting air-fuel mixture is ejected from the ejection port;

a second tube portion having an open end and a closed end, the closed end being located closer to the ejection port than the open end, the second tube portion extending in the first tube portion toward the ejection port;

a third tube portion that is disposed at least partially inside the second tube portion, the third tube portion having an open end and an annular wall that couples the third tube portion with an inner wall of the first tube portion;

a burner head that connects an inner circumferential surface of the first tube portion with an outer circumferential surface of the second tube portion, wherein the burner head and the second tube portion partition a space inside the first tube portion into a premixing chamber including a space inside the second tube portion and a combustion chamber located outside the second tube portion, the combustion chamber leading to the ejection port;

a communication passage provided in the burner head, the communication passage being oriented relative to the second tube portion so that air-fuel mixture that has been premixed in the premixing chamber flows through the open end of the second tube portion into a mixing chamber positioned upstream from the communication passage and flows from the mixing chamber through the communication passage into the combustion chamber, wherein the mixing chamber is partitioned from a space inside the first tube portion upstream from the communication passage by the annular wall of the third tube portion;

a heat exchanging portion arranged in the second tube portion, wherein the heat exchanging portion vaporizes liquid fuel with combustion heat of the combustion chamber and supplies the vaporized fuel to the premixing chamber, and an outer surface of the second tube portion functions as a heat receiving surface of the heat exchanging portion;

an ignition portion arranged in the combustion chamber; and a fuel supply section including:

a vaporized fuel supply section that includes an electric heater, the vaporized fuel supply being configured to vaporize liquid fuel by being heated by the electric heater and supply the vaporized fuel to the premixing chamber, a liquid fuel supply section configured to supply liquid fuel to the heat exchanging portion to vaporize the liquid fuel and supply the vaporized fuel directly to the premixing chamber; and wherein the second tube portion includes a heat receiving tube, which is an inner tube, and a cover, which is an outer tube covering an outer circumferential surface of the heat receiving tube, the heat exchanging portion includes a flow passage defined by the outer circumferential surface of the heat receiving tube and an inner circumferential surface of the cover, and liquid fuel flowing through the flow passage is vaporized with combustion heat of the combustion chamber.

2. The burner according to claim 1, wherein the outer circumferential surface of the heat receiving tube includes a groove extending to be continuous from the closed end to the open end, the groove defining the flow passage, the closed end is an inflow end that allows liquid fuel to flow into the groove, and the fuel supply section includes a supply pipe, which extends to the inside of the heat receiving tube and supplies liquid fuel to the inflow end.

3. The burner according to claim 1, wherein the heat exchanging portion includes a fin, which is arranged on an outer circumferential surface of the cover and faces the combustion chamber.

4. The burner according to claim 1, further comprising control circuitry configured to control driving of the fuel supply section, wherein when the second tube portion reaches a target temperature during driving of the vaporized fuel supply section, the control circuitry is configured to stop driving of the vaporized fuel supply section and drive only the liquid fuel supply section.

5. The burner according to claim 1, further comprising control circuitry configured to control driving of the fuel supply section, wherein the control circuitry is configured to drive the liquid fuel supply section without driving the vaporized fuel supply section when temperature of the second tube portion is higher than or equal to a target temperature.

* * * * *